US007784350B2

(12) United States Patent
Pelletier

(10) Patent No.: US 7,784,350 B2
(45) Date of Patent: Aug. 31, 2010

(54) DOWNHOLE TRANSDUCER WITH ADJACENT HEATER

(75) Inventor: Michael T. Pelletier, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 647 days.

(21) Appl. No.: 11/672,173

(22) Filed: Feb. 7, 2007

(65) Prior Publication Data

US 2008/0185142 A1 Aug. 7, 2008

(51) Int. Cl.
*G01L 19/04* (2006.01)
*E21B 47/06* (2006.01)

(52) U.S. Cl. ..... 73/708; 73/152.13

(58) Field of Classification Search ..... 73/152.13, 73/702, 708, 756

See application file for complete search history.

(56) References Cited

U.S. PATENT DOCUMENTS

| | | | | |
|---|---|---|---|---|
| 3,355,949 | A | 12/1967 | Elwood et al. | |
| 3,668,927 | A * | 6/1972 | Howell et al. | 73/152.13 |
| 4,176,557 | A * | 12/1979 | Johnston | 73/708 |
| 4,550,610 | A | 11/1985 | EerNisse | |
| 4,607,530 | A | 8/1986 | Chow | |
| 4,741,213 | A | 5/1988 | Hojoh | |
| 4,754,646 | A | 7/1988 | EerNisse et al. | |
| 4,802,370 | A | 2/1989 | EerNisse et al. | |
| 4,936,147 | A | 6/1990 | EerNisse et al. | |
| 5,048,323 | A | 9/1991 | Stansfeld et al. | |
| 5,221,873 | A | 6/1993 | Totty et al. | |
| 5,231,880 | A | 8/1993 | Ward et al. | |
| 5,299,868 | A | 4/1994 | Dennis et al. | |
| 5,317,917 | A | 6/1994 | Dufour | |
| 5,323,855 | A | 6/1994 | Evans | |
| 5,471,882 | A | 12/1995 | Wiggins | |
| 5,578,759 | A | 11/1996 | Clayton | |
| 5,625,152 | A * | 4/1997 | Pandorf et al. | 73/756 |
| 5,808,206 | A * | 9/1998 | Pandorf et al. | 73/756 |
| 6,223,588 | B1 | 5/2001 | Burgass et al. | |
| 6,298,724 | B1 | 10/2001 | Burgass et al. | |
| 6,594,602 | B1 | 7/2003 | Schultz | |
| 6,598,481 | B1 | 7/2003 | Schultz | |
| 2009/0151423 | A1 * | 6/2009 | Wu et al. | 73/1.57 |

FOREIGN PATENT DOCUMENTS

GB 2091426 A * 7/1982

OTHER PUBLICATIONS

John R. Vig et al.; "Fundamental Limits On The Frequency Instabilities of Quartz Crystal Oscillators"; 1994 IEEE International Frequency Control Symposium; pp. 506-523.

John R. Vig; "Quartz Crystal Resonators and Oscillators For Frequency Control and Timing Applications—A Tutorial"; Apr. 2006; http://www.ieee-uffc.org/freqcontrol/tutorials/vig2/tutorial2_files/frame.htm.

* cited by examiner

*Primary Examiner*—John Fitzgerald
(74) *Attorney, Agent, or Firm*—Conley Rose, P.C.

(57) ABSTRACT

An apparatus comprising a downhole measurement tool, a transducer coupled to the measurement tool, the transducer having a body with an outer surface, and a heater disposed adjacent the outer surface to conduct heat from the heater to the outer surface.

20 Claims, 5 Drawing Sheets

DOWNHOLE TRANSDUCER WITH ADJACENT HEATER

BACKGROUND

Physical parameters such as temperature and pressure can be converted into electrical signals by a device known as a transducer. Transducers are found in gauges or sensors for measuring these physical parameters, such as quartz gauges or strain gauges. A quartz gauge, for example, includes a crystal that changes resonant frequency in response to an applied mechanical stress. This stress may be induced by pressure, temperature, and often a combination of both. Other gauges include materials that react to outside stimuli resulting in a measurable electrical response.

It is these reactive materials, whether it is a quartz crystal or a metallic member, that are susceptible to pressure and temperature fluctuations in a surrounding environment. Quartz gauges, for example, that are used in subterranean wells are particularly subject to pressure errors caused by static and dynamic temperatures. Particularly complex, rugged, and caustic is the downhole drilling environment, creating temperature and pressure transient conditions which often distort the measurements taken by precision gauges. There is a strong correlation between accurate downhole measurements and thermal stability of the measurement device. However, compensating for temperature gradients produced by either external heating or by pressure-volume heating has proven difficult.

High precision gauges used in downhole environments require long times to stabilize with their surroundings, which are much different than those at the surface of a well. To obtain accurate data from high precision gauges, the tool assembly having the gauge is held at a depth in the well and the gauge is allowed to come to thermal equilibrium with its surroundings. Whether the time to equilibrium is minutes or hours, the time is very valuable in the cost-sensitive process of well operations. Often, the gauges are fitted with a large contact member or surfaces that communicate with the well bore in an effort to hasten thermal equilibrium. However, downhole tool assemblies often involve packaging components in close proximity to each other, therefore restricting the amount of usable space for such components.

The design of pressure transducers has long been an effort to minimize temperature effects, or to accurately determine the temperature and correct the pressure reading through modeling and signal processing. The combination of quickly obtaining accurate measurements from precision gauges in an unstable downhole environment and compact tool assembly designs is pushing the limits of current downhole precision gauges.

SUMMARY

An apparatus comprising a downhole measurement tool, a transducer coupled to the measurement tool, the transducer having a body with an outer surface, and a heater disposed adjacent the outer surface to conduct heat from the heater to the outer surface.

BRIEF DESCRIPTION OF THE DRAWINGS

For a detailed description of exemplary embodiments of the invention, reference will now be made to the accompanying drawings in which.

NOTATION AND NOMENCLATURE

Certain terms are used throughout the following description and claims to refer to particular system components. As one skilled in the art will appreciate, companies may refer to a component by different names. This document does not intend to distinguish between components that differ in name but not function. In the following discussion and in the claims, the terms "including" and "comprising" are used in an open-ended fashion, and thus should be interpreted to mean "including, but not limited to . . . . " Also, the term "couple" or "couples" is intended to mean either an indirect or direct connection. Thus, if a first device couples to a second device, that connection may be through a direct connection or through an indirect connection via other devices and connections.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

Figure 1:
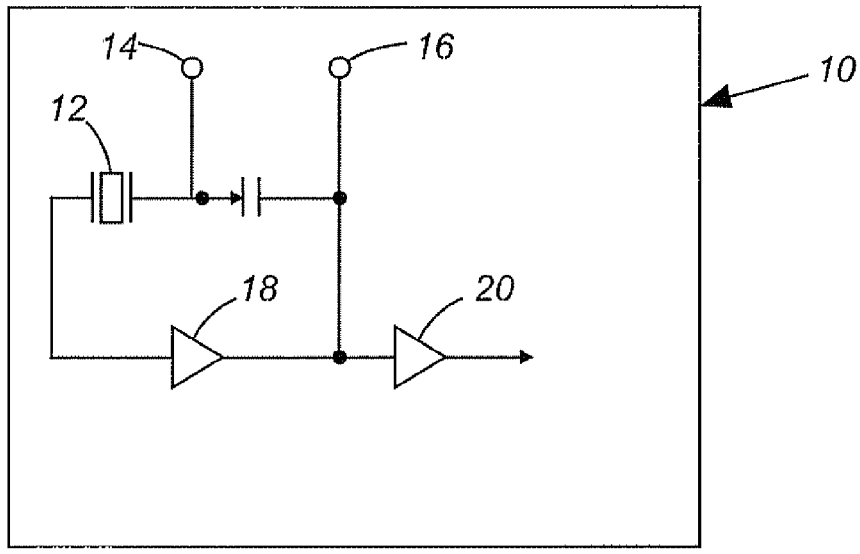
Fig.1 (Prior Art)
FIG. 1 shows a schematic drawing of a basic crystal oscillator.

Referring initially to FIG. 1, a representative schematic drawing of a basic piezoelectric crystal oscillator 10 is shown. The exemplary oscillator 10 comprises a crystal resonator 12, connections 14 and 16 across which a tuning voltage may be applied, an amplifier 18, and an output frequency 20. The oscillator 10 is used in numerous temperature and/or pressure gauges consistent with the teachings herein.

Figure 2:
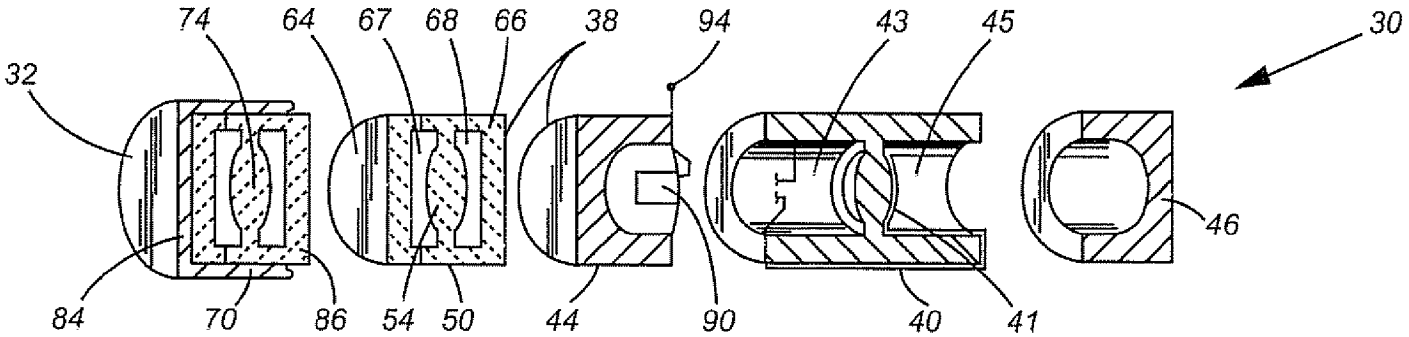
Fig.2 (Prior Art)
FIG. 2 shows an expanded, cross-section view of a transducer.
Figure 3:
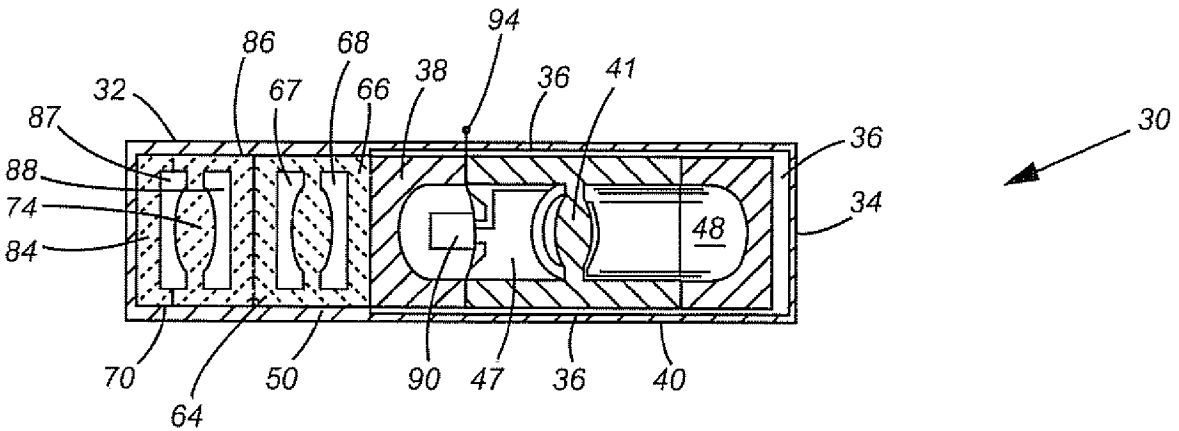
Fig.3 (Prior Art)
FIG. 3 shows a cross-section view of the transducer of FIG. 2.

Referring now to FIGS. 2 and 3, an exemplary embodiment of a pressure transducer is shown. A pressure transducer 30 comprises a metal case 32, of stainless steel for example. A pressure port 34 (FIG. 3) permits fluid to enter a pressure chamber 36 inside the case 32. A transducer body 38 is cut from a quartz crystal. In the exemplary embodiment of the transducer 30, the body 38 comprises a pressure sensor 40 designed to respond to pressure, temperature sensor 50 designed to respond to temperature, and reference crystal 70 designed to resonate at a known frequency. The pressure transducer 30 includes other arrangements of sensors such that it operates as a pressure and/or temperature gauge consistent with the teachings herein.

With continued reference to FIGS. 2 and 3, the pressure sensor 40 is designed to produce electrical signals in response to pressure changes in the pressure chamber 36. The pressure sensor 40 includes a pressure resonator 41, cavities 43, 45, end caps 44, 46, and hermetically sealed chambers 47, 48, shown in FIG. 3. The transducer 30 further includes the temperature sensor 50 having a temperature resonator 54, chambers 67, 68, and quartz crystal end caps 64, 66. The chambers 67, 68 may be smaller than the chambers 47, 48 of the pressure sensor 40 and similarly hermetically sealed. The transducer also includes the reference crystal 70 having a reference resonator 74, chambers 87, 88, and quartz crystal end caps 84, 86. The chambers 87, 88 may be relatively small compared to the pressure sensor chambers 47, 48 and similarly hermetically sealed.

The pressure sensor chamber 47 of the transducer 30 contains microelectronics 90. Alternatively, the microelectronics 90 are placed in chambers 48, 67, 68, 87, 88, or any combination thereof, or in a separate chamber created expressly for the purpose of containing microelectronics. The transducer microelectronics 90 includes circuitry for electrically exciting the pressure resonator 41, the temperature resonator 54, and the reference crystal resonator 74. In response to the excitation signal and physical parameters of temperature and pressure, the pressure sensor 40 produces an electrical signal input to the microelectronics 90. Also in response to the excitation signal and physical parameters of temperature and pressure, the temperature sensor 50 and the reference crystal 70 each produce an electrical signal input to the microelectronics 90. An output signal is then provided to the output terminal 94, in the form of a pressure reading, or pressure and temperature readings.

The details of pressure transducer 30 are described herein for exemplary purposes only, as various other transducers may be used consistent with the teachings herein.

Figure 4:
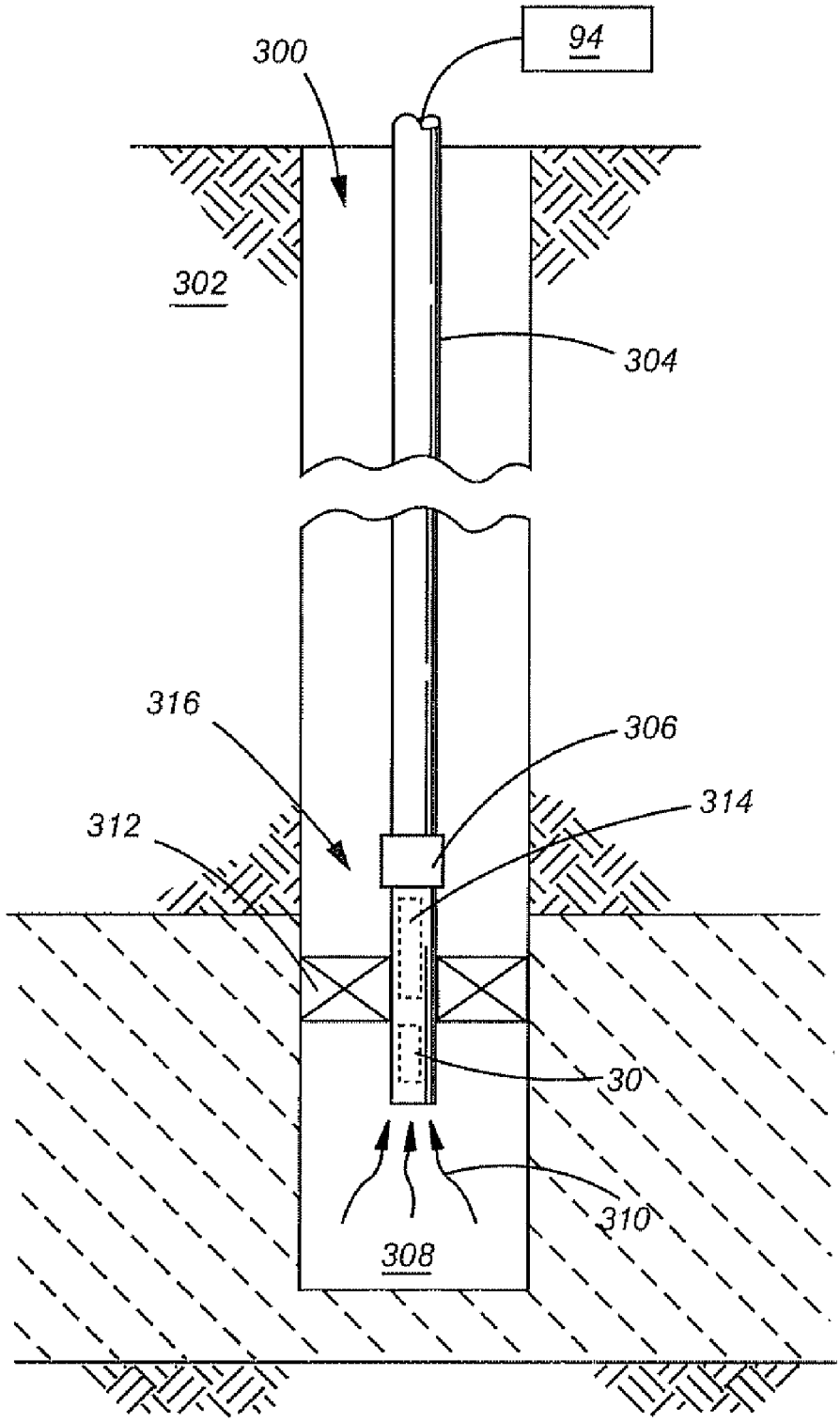
Fig.4 (Prior Art)
FIG. 4 shows a partial view of a measurement system and transducer conveyed into a well.

Referring now to FIG. 4, the transducer 30 is placed in an oil or gas well 300 in the earth 302. The transducer assembly 30 is lowered through tubing 304 containing a valve 306 into a downhole environment 308 containing a fluid such as oil or gas 310. The downhole environment 308 may be sealed by means of packing 312 and the valve 306. The temperature and pressure parameters of the fluid 310 are transformed into electrical signals by the transducer assembly 30, and transmitted to the surface as pressure, or temperature and pressure readings at the output terminals 94.

The embodiment of FIG. 4 for conveying the transducer 30, or any transducer consistent with the teachings herein, to the downhole environment 308 is exemplary only, as many other means for conveying the transducer 30 to the downhole environment 308 are consistent with the teachings herein. For example, a measurement tool 314 such as a reservoir description tool, a measurement or logging while drilling tool, a formation evaluation tool or any other measurement tool familiar to those skilled in the art may be part of a downhole assembly 316 used instead to convey the transducer. The transducer conveyance may also be an autonomous application, whereby a remote device is dropped into the well, measurements are taken, and telemetry means are used to communicate data to the surface. In addition to the previously described exploratory tools, permanent applications such as "smart completions" may be used to house and convey the transducer.

Figure 5:
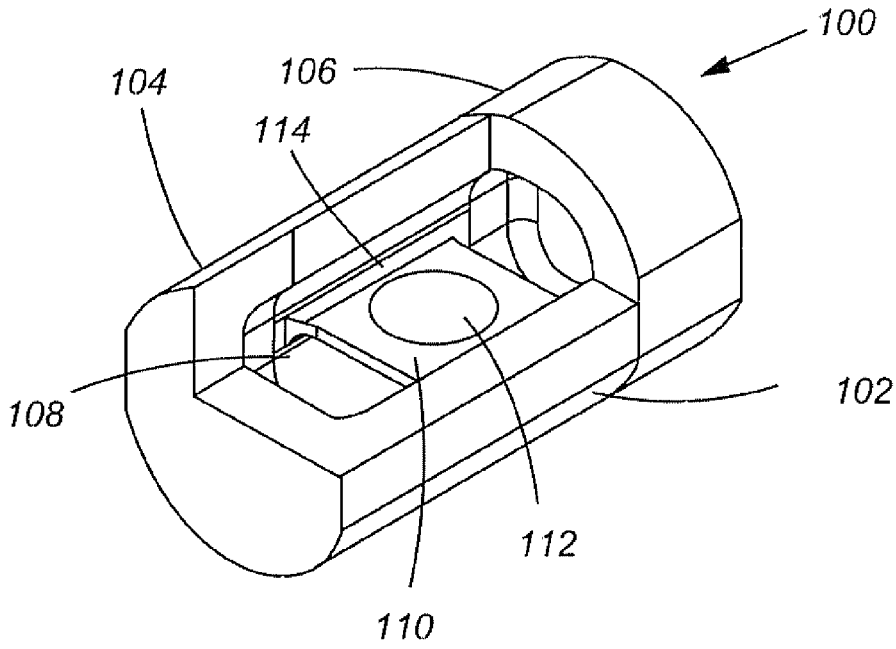
FIG. 5 shows a partial cutaway, perspective view of another embodiment of a pressure transducer.

Referring now to FIG. 5, a further embodiment of a basic pressure transducer is shown in a partial cutaway, perspective view. The transducer 100 includes a cylindrical body 102 and end caps 104, 106. An internal cavity 108 contains various operative components of the transducer 100, most notably, a quartz shear resonator 110 having an electrode 112. The quartz resonator 110 reacts to a fluid pressure and provides a signal to other parts of the transducer 100 via a connection 114 to the body 102.

Figure 6:
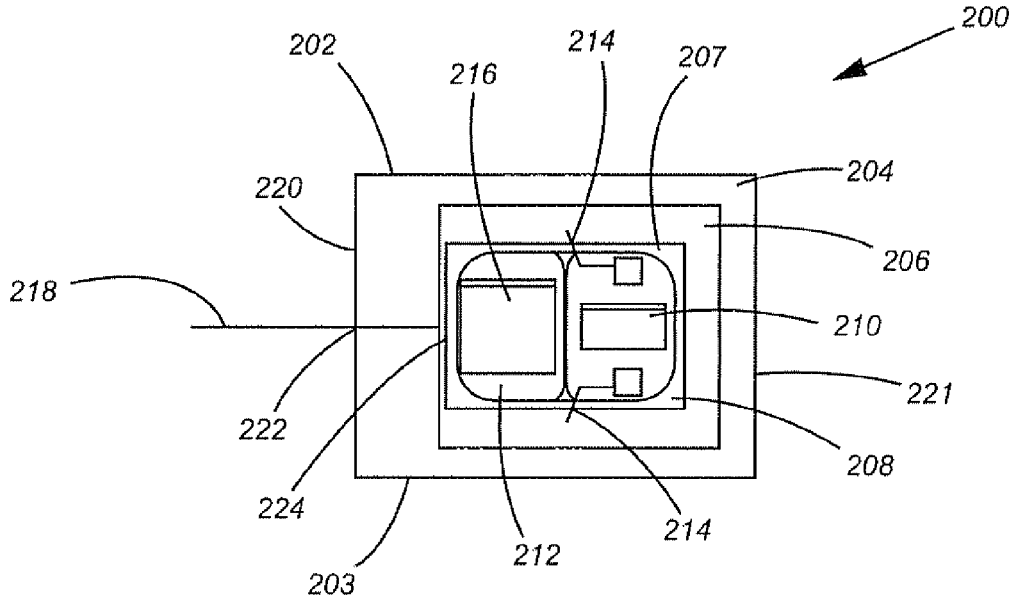
Fig.6 (Prior Art)
FIG. 6 shows a schematic view of a transducer package.

Referring next to FIG. 6, a schematic representation of a further, more detailed embodiment of the transducer 100 of FIG. 5 is shown as a transducer package 200. The transducer package 200 includes a case 202 having a body portion 204. The case 202 is preferably made of a high-strength, conductive metal, but may include other materials, and an outer surface 203 of the case 202 generally resembles a cylinder, although other outer shapes of the case 202 are consistent with the teachings herein. The transducer package 200 further includes a shock mount 206, a cavity 207 having a buffer material 208, and a capsule 212. Capsule 212 contains sensitive components, such as a gauge 210 and output terminals 214, so it is necessary to insulate and protect these components from outside forces. The buffer material 208, such as a hydraulic fluid, and the shock mount 206 serve to insulate and protect from outside forces.

The capsule 212 includes the quartz gauge 210, output terminals 214, and a compartment 216 including various additional transducer components such as microelectronics, sensors, controls or other components associated with transducers and consistent with the teachings herein. The data output from the quartz gauge 210, generated and communicated consistently with that previously described, is received by the output terminals 214 and communicated to other components of the downhole tool. A hydraulic fluid line 218, which is coupled to the cavity 207 at end 224 and extends through an aperture 222 in an end 220 of the body 204, carries a pressurized fluid from a hydraulic system (not shown) to the buffer fluid 208 in the cavity 207 surrounding the capsule 212. Within or adjacent fluid line 218 are electrical lines for communicating with the electrical components of the capsule 212. Alternatively, electrical connections may be placed in various other locations in the transducer package 200, such as near the terminals 214. The body 204 also includes an opposite end 221. Various gauges, most notably quartz and strain gauges, are contemplated by gauge 210 and consistent with the teachings herein.

Figure 7:
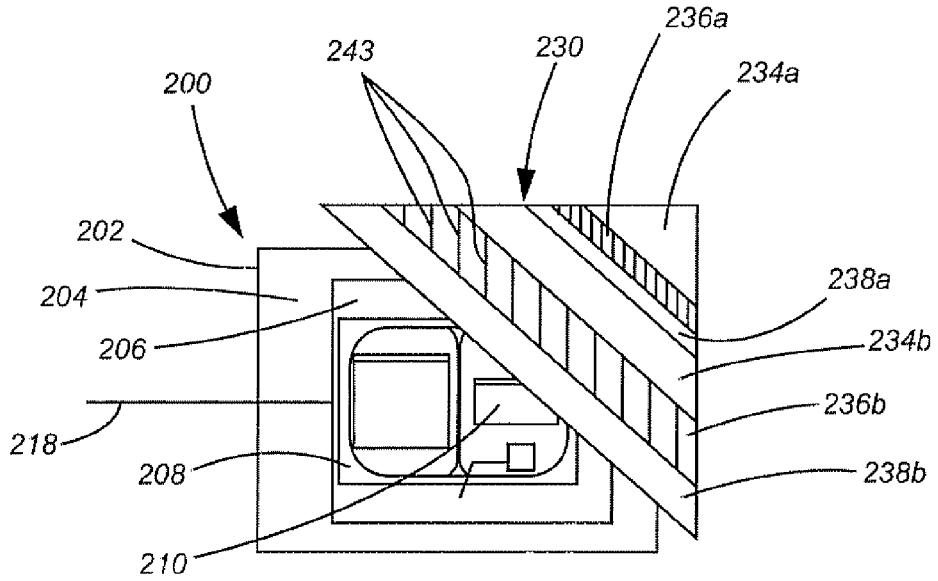
FIG. 7 shows a schematic view of the transducer package of FIG. 6 and a heater in accordance with an embodiment of the invention.
Figure 8C:
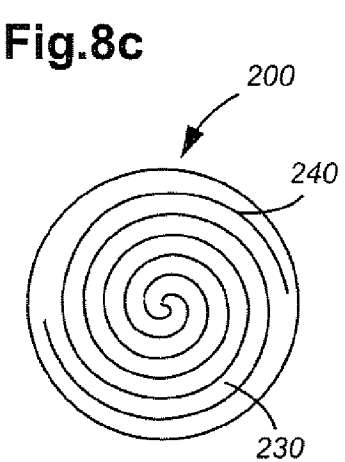
FIG. 8*c* shows another end schematic view of the transducer package and heater of FIG. 7.

To further insulate the transducer package 200 from the dynamic temperature and pressure conditions of the downhole environment 308, transducer 200 is located adjacent a heater. Referring now to FIGS. 7-8*c*, transducer 200 is overlaid or wrapped in a heater 230, as partially shown in FIG. 7. Heater 230 includes a layered, flexible material having electrical heating elements that conforms to the outer shape of the transducer 200. A fully wrapped heater jacket 242 is shown in FIG. 8*a*.

With reference to FIG. 7, the heater 230 comprises layers 234*a*, 236*a*, and 238*a*. The layer 234*a* is a copper foil layer to distribute heat from individual heating elements evenly across the outer surface of the transducer package 200. The layer 236*a* includes individual heating elements 243. The layer 238*a* includes insulation. Insulation, for example, includes glass tape, ceramic paper or other insulation materials. A second grouping of layered materials 234*b*, 236*b*, 238*b* may also be part of the final heater jacket 242 wrapped around transducer 200, as well as additional layered materials such that the layering scheme is repeated a plurality of times to form completed heater jacket 242.

Figure 8A:
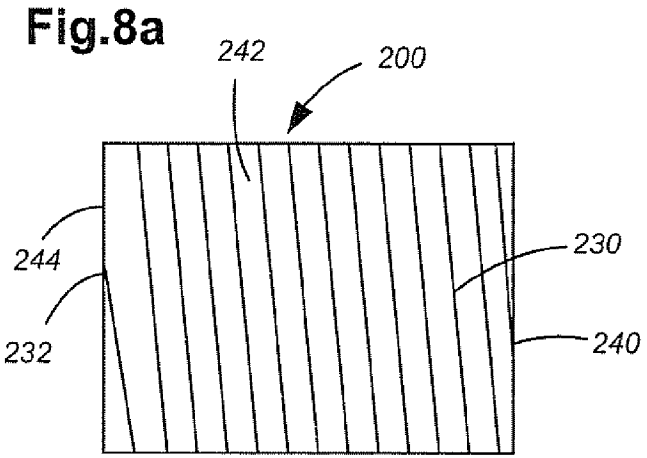
FIG. 8*a* shows a schematic side view of the transducer package and heater of FIG. 7.
Figure 8B:
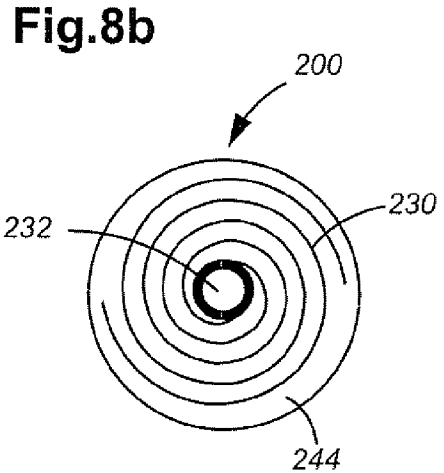
FIG. 8*b* shows an end schematic view of the transducer package and heater of FIG. 7.

As shown in FIGS. 8*a*-8*c*, the transducer package 200 is fully wrapped in heater 230 to form a heater jacket 242. An end 244 of wrapped transducer 200 is shown in FIG. 8*b*, also covered by heater 230. The end 244 includes an aperture 232 for receiving hydraulic fluid conduit 218 (FIGS. 6 and 7), which carries the pressurized fluid to and from the transducer package 200. Aperture 232 may also receive electrical connections, as electrical lines may coincide with fluid line 218 as previously described. An opposite end 240 from end 244 is also covered by heater 230. Although heater jacket 242 is shown to cover substantially all of the outer surface of transducer package 200, it is consistent with the teachings herein that heater 230 partially cover the transducer package 200. For example, heater 230 may cover only the curved side surfaces of the cylindrical transducer package 200 while leaving the flat ends 220, 221 uncovered. In embodiments of the invention described herein, significant portions of the outer surface of the transducer or transducer package are covered or wrapped by a heater consistent with the teachings herein to achieve a substantially uniform heat distribution over the transducer. A uniform heat distribution ensures thermal equilibrium throughout the transducer and minimizes errors due to temperature effects. Consequently, the accuracy of valuable pressure measurements is vastly improved.

One type of flexible, conformable, electrical heater has been described in detail herein; however, it is consistent with the teachings herein that other heaters may be used to partially or fully cover the transducer 200 such that the internal temperature of the transducer 200 may be regulated by a uniformly distributed heat field. For example, a Minco-brand thin-film heater laminated with Kapton is consistent with the teachings herein (www.minco.com). Such a thin-film heater comprises a wire used as the heating element, wherein the resistance of the wire is measured to obtain a temperature reading. Thus, the wire heating elements act as a thermometer, and these devices may also be known as a resistance thermal device. Other heaters, preferably flexible, conformable, layered and substantially flat may also be used in the embodiments described herein. Alternatively, the heater may be pre-formed to the outer shape of the transducer such that the heater rigidly abuts or is adjacent the transducer outer surface. In a further embodiment of the invention, the heater is an integral part of the case 202.

Figure 9:
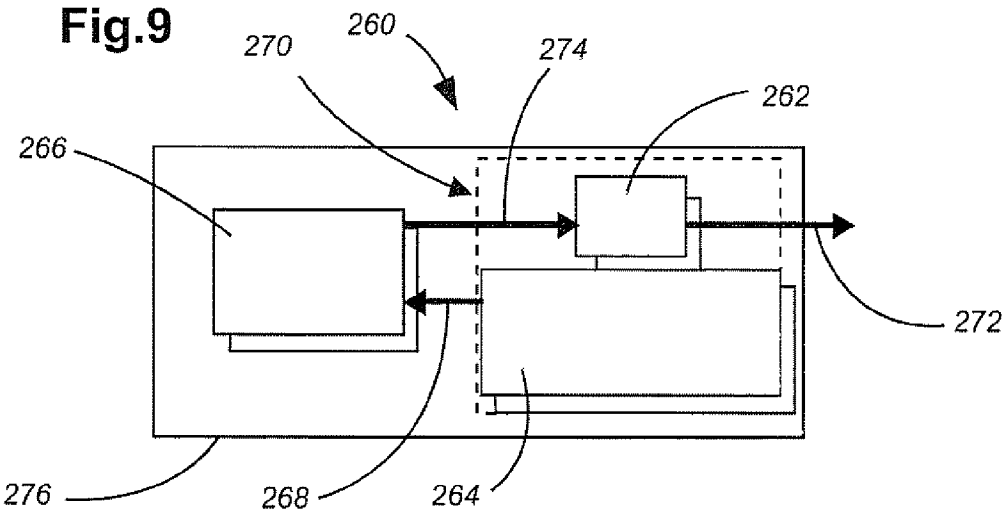
FIG. 9 shows a schematic view of a control assembly for a heater in accordance with an embodiment of the invention.

Referring now to FIG. 9, a gauge and control assembly 260 is shown schematically. The assembly 260 includes a gauge 262, such as a quartz gauge, a temperature sensor 264, and a controller 266. The temperature sensor 264 communicates with the controller 266 via a connection 268, the controller 266 communicates with the gauge 262 via a connection 274, and the gauge 262 outputs data via an output terminal 272. In one embodiment, a heater as described herein is applied to a case 270 surrounding the gauge 262 and the temperature sensor 264. In this embodiment, the controller 266 is located outside the heated device and inside an assembly case 276 that is located in the downhole tool. In an alternative embodiment, the case 276 is the case for the transducer and control assembly and the heater is applied to the case 276. In these embodiments, the heating jacket is controlled by a thermostat, which may be part of the controller 266. The controller 266, or the controller located in the compartment 216 of the transducer capsule 212, include a microcontroller such as a proportional temperature controller or other controllers consistent with the teachings herein.

Alternatively, as suggested with respect to the thin-film heater retained in Kapton tape, a separate temperature sensor is eliminated in favor of the resistance thermal abilities of the heating elements. The heating elements of heater 230 have a resistance that can be measured and converted to a temperature. This type of temperature measurement provides a uniformly distributed heat measurement, a measure of the stability of the system, and a less bulky system minus a separate temperature sensor.

In operation, the transducer 200 with the heating jacket 242, or temperature control system, is disposed on a reservoir description tool, a measurement or logging while drilling tool, or other means for conveying a measurement system to a downhole environment as described herein. The measurement system coupled to transducer 200 with the heating jacket 242 is lowered into the borehole and downhole environment in a normal manner, such as that seen in FIG. 4. The dynamic downhole drilling environment is drastically different from that environment at or near the surface, or at different locations in the well. The change in temperature in the downhole drilling environment negatively affects precisions instruments such as a pressure transducers and the readings they produce. Thermal equilibrium is not easily achieved naturally between the pressure transducer and the downhole environment. Therefore, heat is evenly distributed over the transducer 200 via heating jacket 242 to more quickly achieve thermal equilibrium and thereby save valuable time and decrease downhole operations costs. As previously noted, there is a strong correlation between thermal stability of the transducer and the accuracy of the readings taken from the transducer.

The transducer 200 and/or the heating jacket 242 are operated via the gauge and control assembly 260 by transmitting signals from the surface of the well, or, alternatively, by transmitting signals from the downhole equipment that has been pre-programmed. Heat is applied to the transducer package 200 at a pre-determined temperature, or, alternatively, at a pre-determined rate of heat transfer. For example, when heating jacket 242 is operating, it is commanded to maintain the gauge in the transducer at a temperature 25 to 50° C. greater than the greatest predicted temperature for the downhole environment. Controlling the temperature of the transducer package 200 and maintaining a known temperature, or range thereof, consistent with the teachings herein simplifies the transducer calibration process by minimizing the number of calibration points associated with the transducer. Maintaining a temperature above the temperature of the surrounding downhole environment reduces thermal gradient effects caused by operations of other parts of the downhole tool, and allows the temperature controllers to simply shut down the heater in response to heating from buffer fluid compression rather than refrigeration of the transducer.

The transducer case is made from a conductive material that conducts heat to the internal volume of the case, and the gauge, in the same evenly distributed manner that is employed by the heating jacket. The heating jacket may be operated at any point during the trip from the surface to the downhole environment, and continuously from the surface to the downhole environment. Further, the temperature control system may be pre-heated at the surface by an oven, for example, such that as the tool descends into the well, the external layers of the temperature control system will draw less power. When the transducer 200 reaches the desired depth in the well, it is near thermal equilibrium with the downhole environment such that accurate, stable pressure or other measurements may be taken with the transducer. More precisely, the transducer system has been dynamically controlled at a temperature above ambient such that accurate and stable measurements may be taken.

The above discussion is meant to be illustrative of the principles and various embodiments of the present invention. Numerous variations and modifications will become apparent to those skilled in the art once the above disclosure is fully appreciated. For example, embodiments of the invention may include various transducers or sensors, or various heaters to abut a substantial portion of the outer surface of the transducer consistent with the teachings herein. It is intended that the following claims be interpreted to embrace all such variations and modifications.

What is claimed is:

1. An apparatus comprising:

a downhole tool to receive an ambient downhole fluid pressure;

a pressure transducer coupled to said downhole tool to receive said ambient downhole fluid pressure, said transducer having a body with an outer surface; and a heater disposed adjacent said outer surface to heat said outer surface.

2. The apparatus of claim 1 wherein said heater further comprises electrical heating elements.

3. The apparatus of claim 1 wherein said heater further comprises a heating jacket that covers substantially all of the pressure transducer body outer surface.

4. The apparatus of claim 1 wherein the downhole tool comprises at least one of a reservoir description tool, a measurement while drilling tool, a logging while drilling tool, a formation evaluation tool, an autonomous remote device, and a permanent smart completion.

5. The apparatus of claim 1 further comprising a controller coupled to at least one of said pressure transducer and said heater.

6. The apparatus of claim 1 wherein said heater comprises a plurality of heating elements evenly distributed over said outer surface.

7. The apparatus of claim 1 wherein said heater further comprises a resistance thermal device to measure a temperature of said outer surface.

8. The apparatus of claim 1 further comprising a thermostat coupled to said heater to control said heater.

9. The apparatus of claim 1 wherein the transducer is a pressure gauge.

10. The apparatus of claim 9 wherein the pressure gauge comprises at least one of a quartz crystal and a strain gauge.

11. The apparatus of claim 1 further comprising:

a tool body incorporating said downhole tool and an interior chamber to receive said ambient downhole fluid pressure;

a transducer package incorporating said pressure transducer and mounted in said tool body;

wherein said heater comprises a heating jacket disposed about said pressure transducer package; and a fluid passageway communicating said ambient downhole fluid pressure to an interior of both said pressure transducer package and said heating jacket.

12. The downhole tool of claim 11 further comprising a uniform conductive heat field between said heating jacket and said pressure transducer package.

13. The downhole tool of claim 11 further comprising a controller coupled to said pressure transducer package.

14. The downhole tool of claim 11 further comprising a thermostat coupled to said heating jacket.

15. The apparatus of claim 11 wherein said heating jacket further comprises a resistance thermal device to measure a temperature of said pressure transducer package.

16. A method comprising:

disposing a heater adjacent to a pressure transducer on a downhole tool;

lowering the tool into a well;

communicating an ambient downhole fluid pressure to the pressure transducer through the downhole tool; and using the heater to control a temperature of the pressure transducer.

17. The method of claim 16 further comprising:

maintaining the temperature of the pressure transducer above an ambient downhole temperature.

18. The method of claim 16 further comprising:

stabilizing the temperature of the pressure transducer with an ambient downhole temperature for taking an accurate pressure measurement with the pressure transducer.

19. The method of claim 16 further comprising:

heating the pressure transducer with the heater during the entire lowering of the tool into the well from the surface of the well to a desired depth in the well.

20. The method of claim 16 further comprising:

pre-heating the pressure transducer before lowering the tool into the well.

* * * * *